US007365635B2

(12) United States Patent
Oberhauser

(10) Patent No.: US 7,365,635 B2
(45) Date of Patent: Apr. 29, 2008

(54) OVERHEAD DOOR IMMOBILIZER

(76) Inventor: Robert Oberhauser, 4 Settlers Farm Rd., Monroe, CT (US) 06468

( * ) Notice: Subject to any disclaimer, the term of this patent is extended or adjusted under 35 U.S.C. 154(b) by 535 days.

(21) Appl. No.: 10/988,330

(22) Filed: Nov. 12, 2004

(65) Prior Publication Data

US 2005/0107040 A1 May 19, 2005

Related U.S. Application Data

(60) Provisional application No. 60/519,670, filed on Nov. 13, 2003.

(51) Int. Cl.

| | |
|---|---|
| ***B60R 25/00*** | (2006.01) |
| ***G05B 19/00*** | (2006.01) |
| ***G06F 7/00*** | (2006.01) |
| ***H04B 1/00*** | (2006.01) |
| ***H04Q 1/00*** | (2006.01) |

(52) U.S. Cl. ..... 340/5.71; 340/5.26; 340/573; 340/593.3

(58) Field of Classification Search ..... 340/5.26, 340/457, 573, 593.3, 825.69, 686, 426.28, 340/440; 49/25–28, 199, 280; 318/16, 280, 318/466

See application file for complete search history.

(56) References Cited

U.S. PATENT DOCUMENTS

| | | | | |
|---|---|---|---|---|
| 4,383,206 | A * | 5/1983 | Matsuoka et al. | 318/445 |
| 4,819,379 | A * | 4/1989 | Kenzelmann et al. | 49/280 |
| 4,922,168 | A | 5/1990 | Waggamon et al. | 318/286 |
| 5,402,105 | A | 3/1995 | Doyle et al. | 340/539 |
| 5,428,923 | A | 7/1995 | Waggamon | 49/28 |
| 5,455,733 | A | 10/1995 | Waggamon | 361/115 |
| 6,049,289 | A | 4/2000 | Waggamon et al. | 340/825.31 |
| 6,118,243 | A | 9/2000 | Reed et al. | 318/468 |
| 6,176,039 | B1 | 1/2001 | Craig | 49/26 |
| 6,225,768 | B1 * | 5/2001 | Cookson et al. | 318/280 |
| 6,346,889 | B1 * | 2/2002 | Moss | 340/686.1 |
| 6,603,393 | B2 * | 8/2003 | Sumada et al. | 340/425.5 |
| 6,667,684 | B1 | 12/2003 | Waggamon et al. | 340/5.71 |
| 6,975,203 | B2 * | 12/2005 | Brookbank et al. | 340/5.26 |

* cited by examiner

*Primary Examiner*—Brian Zimmerman
*Assistant Examiner*—Nam Nguyen
(74) *Attorney, Agent, or Firm*—Ware, Fressola, Van Der Sluys & Adolphson

(57) ABSTRACT

An overhead door immobilizer deactivates power to the power head operator in a conventional overhead door system to prevent the door from damaging the hatch portion of a vehicle when the hatch portion is in an open position or orientation. A hatch position transmitter (HPT) module mounted on the hatch portion transmits a coded RF signal. A power receiver module (PRM) receives and decodes the HPT RF signal and operates to deactivate power when the hatch position is in an open position and activate power when the hatch position is in a closed position.

18 Claims, 6 Drawing Sheets

OVERHEAD DOOR IMMOBILIZER

This application claims the benefit of U.S. Provisional Application Ser. No. 60/519,670 filed Nov. 13, 2003.

TECHNICAL FIELD

The present invention relates generally to overhead door systems, and in particular to power operated overhead door systems. More specifically, the present invention relates to an overhead door immobilizer system for use with electric garage door openers to preclude door operation and movement when the hatch portion of the vehicle is in an opened orientation.

BACKGROUND OF THE INVENTION

Overhead door systems, particularly electrically operated overhead doors such as for example, residential electric garage door openers (GDOs) have been in use for over 30 years and it is estimated that there are over 30 million electric garage door openers operating in the United States today. Many of these GDOs are equipped with object sensor devices that are designed to stop a garage door from accidentally closing if it encounters any blockage, such as a child, motor vehicle or other object in its path. These object sensor devices are primarily designed as safety devices and are required by law on all GDOs manufactured for use in the United States today. A typical object sensor device as shown in U.S. Pat. No. 4,922,168 (Waggamon et al) is usually paired together as an infrared light beam transmitter and infrared receiver. These units are normally mounted opposite one another on the bottom of each side of the garage door's track and about six inches from the ground. If the beam is broken or interrupted while the garage door is closing or moving down, the GDO will either stop or reverse direction back to the up or open position. Another object sensor device is disclosed in U.S. Pat. No. 6,176,039 (Craig) and is physically mounted on the garage door to sense objects as it travels along with the leading edge of the garage door. Both devices adequately detect objects in proximity to the bottom of the garage door near the end of travel. These devices however cannot detect objects that are in the garage door travel path.

Sport utility vehicles (SUV's), vans and minivans have become very popular particularly for families because they have a larger people and large carrying capacity and therefore are being purchased in increasing numbers for both personal and business use. SUV's, vans, minivans, station wagons and similar vehicles typically have large hatchbacks. When fully or partially opened in a garage, the hatchback sometimes extends into the travel path of many residential garage doors due to inadequate ceiling heights to provide sufficient clearance. In some cases, the hatchback is directly in-line with the overhead door hanging arm which may protrude up to seven inches below the garage door in its open position, and in worst cases, the hatchback may actually touch the open garage door. This condition creates a potential problem especially if someone accidentally operates the electric GDO to open or close the overhead door when the hatch is open. In such instances, the GDO's door hanging arm and/or the garage door's center hinges and door lock scratches or scrapes its way along the surface of the vehicle's open hatch creating substantial damage to the surface paint and finish. In extreme cases, the GDO's door hanging arm can tear away the vehicle's rear windshield wiper on the hatchback or rip off trim causing hundreds of dollars of damage. The above-mentioned infrared devices are not capable in preventing this type of damage to a vehicle's hatchback.

Prior art garage door object sensor systems typically use complicated infrared transmitters and receivers that can be difficult to set-up and maintain and are easily knocked out of alignment making the garage door inoperative without any interfering object being present in the garage door travel path.

A further shortcoming of prior art garage door object sensor systems is objects can only be sensed in the travel path in the forward travel entry closing direction and not in the reverse travel path entry opening direction.

Accordingly there is a need for an overhead door object sensor system that can sense an object when moving in both a forward travel path to an entry closing position and a reverse travel path to an entry open position to immobilize door movement when a hatch portion of a vehicle is in its open position orientation.

It is an object of the present invention therefore to provide an overhead door sensor system to immobilize door movement when the hatch portion of a vehicle is in its open position orientation.

It is a further object of the present invention to provide an overhead door immobilizer that can be used with overhead door electric power opener systems.

SUMMARY OF THE INVENTION

An overhead door immobilizer for preventing an overhead door such as a residential garage door from contacting a vehicle hatch portion in an open position when door operation is attempted to move the door from an entry open position to an entry closed position and from an entry closed position to an entry open position is presented. In a first aspect of the invention, the overhead door immobilizer includes a power receiver module (PRM) electrically connected between an overhead door power head operator and an electrical power source for powering the overhead door power head operator. A hatch position transmitter (HPT) is suitably attached in a convenient location to the hatch portion of a vehicle. The HPT has a first operative state corresponding to the hatch portion being in a first orientation and a second operative state corresponding to the hatch portion being in a second orientation. The power receiver module (PRM) is arranged to be responsive to the hatch position transmitter first operative state whereby electrical power from the electrical power source energizes the overhead door power head operator to move the overhead door between its vertical orientation corresponding to an entry closed position and its horizontal orientation corresponding to an entry open position when an enable command signal is provided to the overhead door power head operator. The power receiver module (PRM) is further responsive to the hatch position transmitter second operative state whereby electrical power from the electrical power source is prevented from energizing the overhead door power head operator to immobilize the overhead door from moving between its entry closed vertical orientation and its entry open horizontal orientation when an enable command signal is provided to the overhead door power head operator.

Preferably, the hatch portion first orientation corresponds to the hatch portion being in a substantially closed position on the vehicle and the hatch portion second orientation corresponds to the hatch portion being in an open position on the vehicle. The substantially closed position may range from the hatch portion being in a fully closed position to a partially open position wherein the HPT remains in its first operative state. The open position may range from the hatch portion being in a fully open position to a partially closed position wherein the HPT remains in its second operative state.

Preferably, the PRM includes an alarm warning indicator responsive to the HPT second operative state to alert a user of the vehicle that the hatch portion is in its second orientation or open position. The alarm warning indicator may be an audible alarm or a visual alarm or a combination of both.

Preferably, the HPT is arranged to transmit a first coded RF signal corresponding to its first operative state and a second coded RF signal corresponding to its second operative state. The PRM is arranged to receive and decode the HPT coded RF signals and respond accordingly to carry out the intended operation.

Preferably, the PRM is responsive to the presence of the HPT first operative state after a pre-defined time interval and the PRM is responsive to the absence of the HPT second operative state after a pre-defined time interval.

The PRM may be separate component part arranged for use with conventional and installed overhead door power head operators or the PRM may be made part of the overhead door power head operator.

In a further aspect of the invention an overhead door immobilizer comprises a power receiver module (PRM) and a hatch position transmitter (HPT) wherein the hatch position transmitter (HPT) transmits a coded hatch-open signal when the hatch position of a vehicle is open and a coded hatch-closed signal when the hatch portion of a vehicle is closed. The power receiver module (PRM) activates electrical power to an overhead door power head operator in response to receiving the hatch-closed coded signal and de-activates electrical power to the overhead door power head operator in response to receiving the hatch-open coded signal when an enable command signal is provided to the overhead door power head operator. The hatch-open coded signal and said hatch-closed coded signal are RF coded signals and the PRM includes control circuitry for receiving and decoding the RF hatch-open coded signal and said RF hatch-closed coded signal.

WRITTEN DESCRIPTION OF PREFERRED EMBODIMENTS

Figure 1:
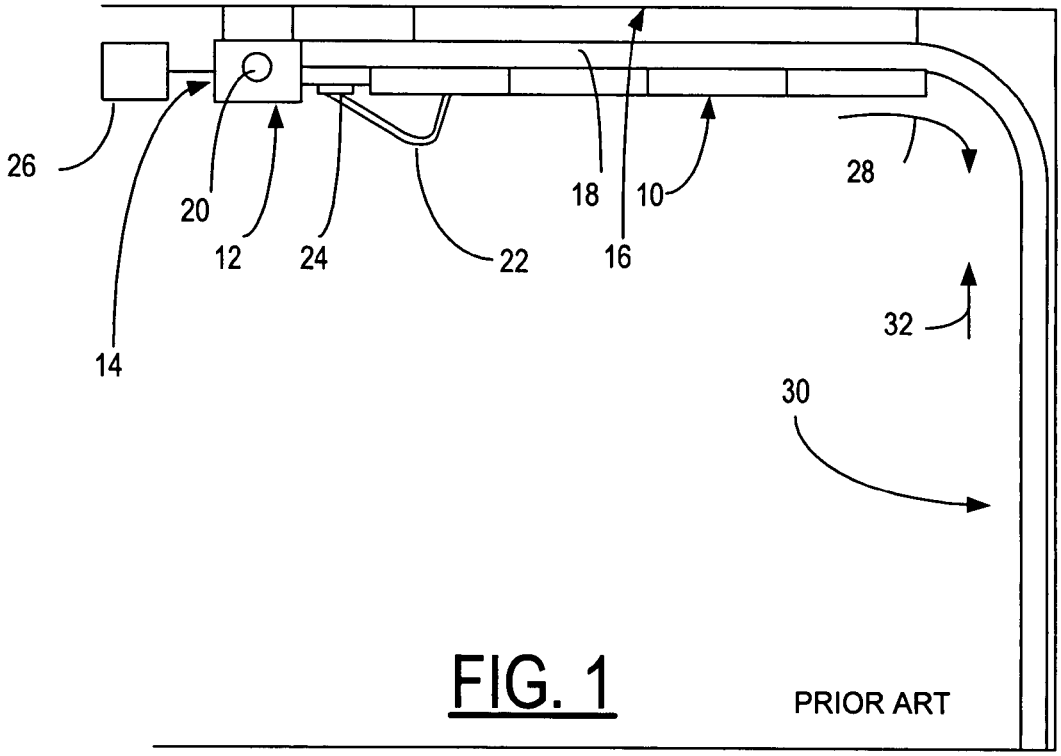
FIG. 1 PRIOR ART
FIG. 1 is a schematic illustration showing a conventional overhead door system having a power head operator for moving the door between an entry open and entry closed position.

Turning now to the drawing and considering the invention in further detail, FIG. 1 illustrates an existing overhead door system, for example, a residential garage door 10 and an existing overhead door power head operator 12 which has a door operator 14 suspended from a ceiling 16. The garage door 10 may be of any one of several types and an upward acting garage door is illustrated and for purposes of explanation is a door made of a plurality of sections hinged together and running in a non-linear path on a curved track 18. The overhead door power head operator 12 is connected to the door 10 by a hanging arm 22 and is driven along a guide member 24 by the electric motor 20 resulting in the door 10 either opening or closing depending upon the direction of travel of the hanging arm 22. The overhead door power head operator 12 is connected to a power source typically a 110 volt AC power source generally designated 26. The operation of the overhead door system illustrated in FIG. 1 is well known and understood to move the door 10 in a downward direction as indicated by the arrow 28 to close or otherwise block an entryway generally designated 30 or to move in an upward direction as indicated by the direction arrow 32 to an open position to unblock the entryway 30. The operation of the overhead door is typically controlled by a pushbutton wired to the overhead door power head operator 12 or via a transmitter device to energize the overhead door power head operator to open or close the door 10.

Figure 2:
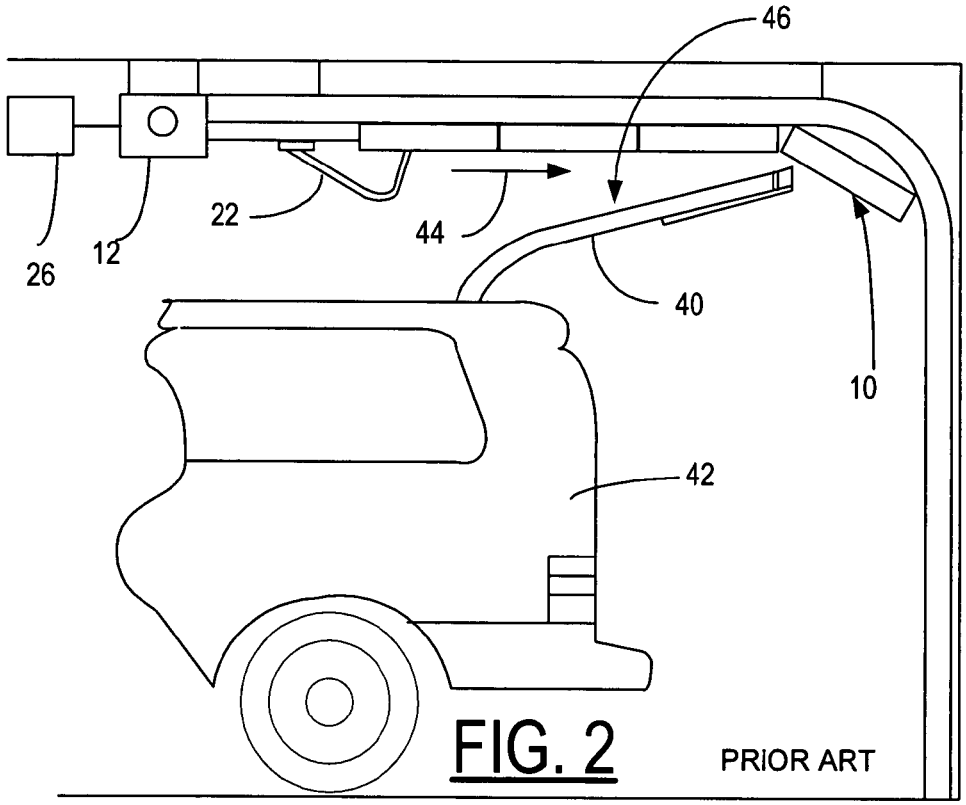
FIG. 2 PRIOR ART
FIG. 2 is a schematic illustration showing the travel path of an overhead door system hanging arm as it might move into contact with the open hatch portion of a vehicle when the overhead door is moving from an entry open position to a entry closed position.
Figure 3:
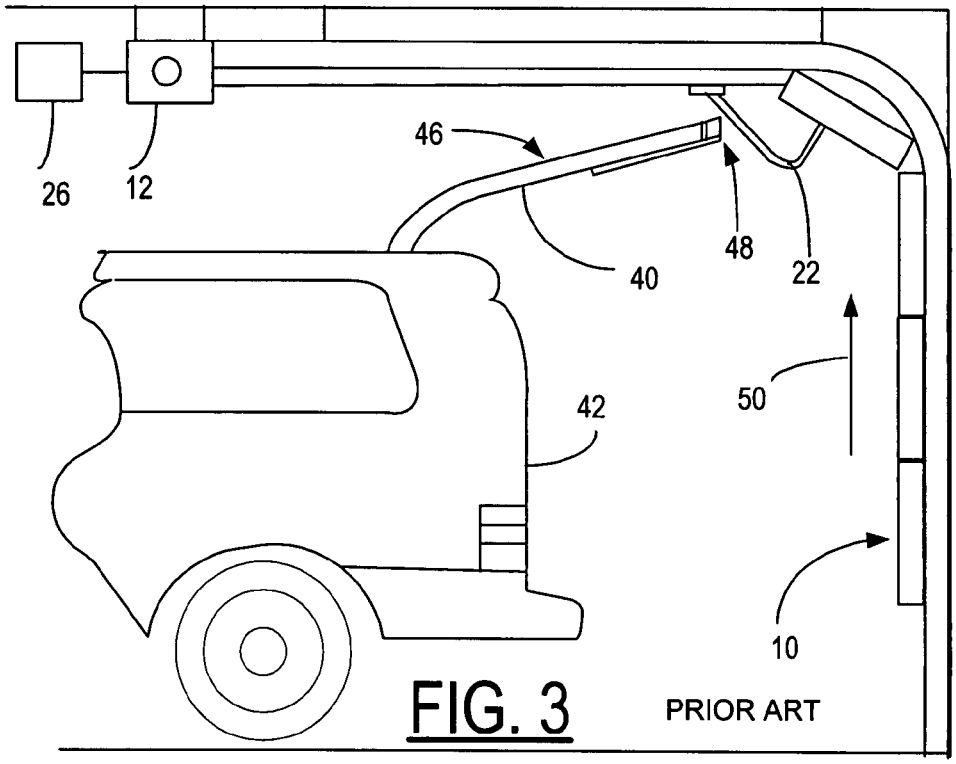
FIG. 3 PRIOR ART
FIG. 3 is a schematic illustration showing an overhead door system hanging arm contacting the open portion of a vehicle when the overhead door is moving from an entry closed position to an entry open position.
Figure 4:
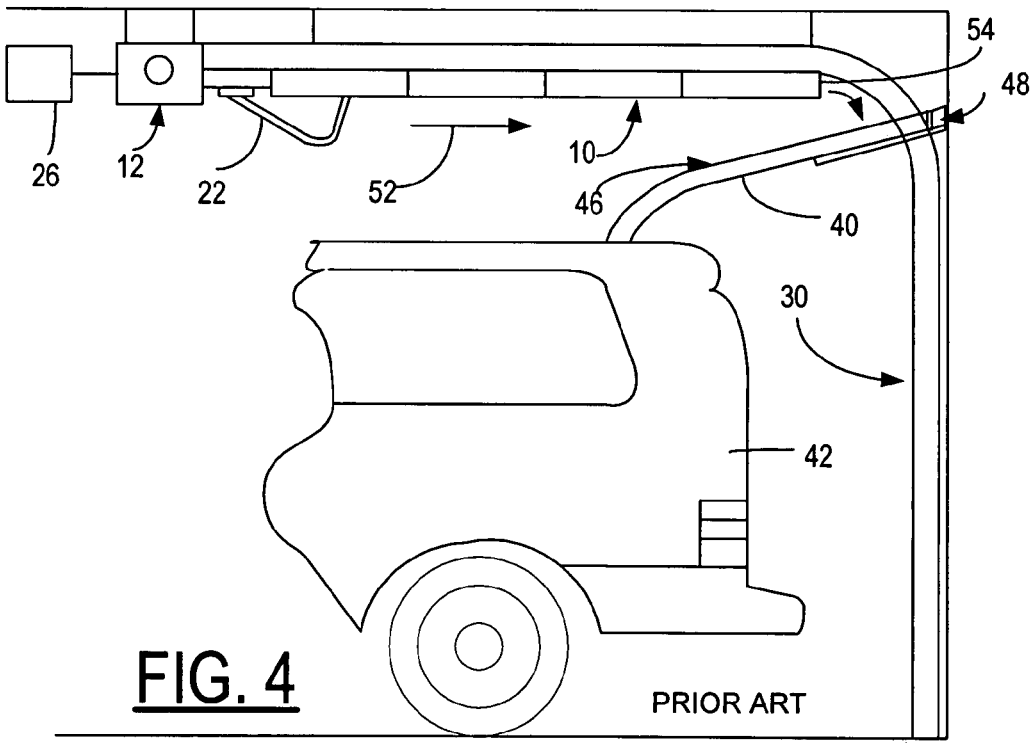
FIG. 4 PRIOR ART
FIG. 4 is a schematic illustration showing an overhead door system wherein the bottom edge of the overhead door moves into contact with the open hatch position of a vehicle extending into the entry way when the overhead door is moving from an entry open position to an entry closed position.

Examples illustrating typical circumstances under which a hatch portion generally designated 40 of a vehicle 42 in an open position as shown in FIGS. 2, 3 and 4 are presented to show how the hatch portion may be damaged by the overhead door 10 or hanging arm 22. In FIG. 2, the door 10 is operated to move from its open position in a downward travel path as indicated by the direction arrow 44 and as the door 10 moves toward its closed position the arm 22 travels in the direction of arrow 44 and into contact with the hatch portion 40 of the vehicle 42 to scrape, dent or otherwise damage the exterior surface 46 of the hatch portion 40. In FIG. 3, the overhead door power head operator 12 is energized to move the door 10 in an upward direction as indicated by the direction arrow 50 from its closed position toward its open position. In this instance, the hanging arm 22 comes in contact with the end region 48 of the hatch portion 40 of the vehicle 42 resulting in the scratching, denting or otherwise damage to the hatch portion 40 as the door moves in the direction indicated by the direction arrow 50. In FIG. 4, the hatch portion 40 of the vehicle 42 is opened whereby the end region 48 extends through the plane of the entryway 30 although the vehicle 42 is fully within the garage enclosure area. In this instance, operation of the overhead door power head operator 12 to close the door 10 causes the hanging arm 22 to drive the door 10 in the direction indicated by the direction arrow 52 attempting to move the door 10 to its closed entry position. As the door 10 moves in the direction as indicated by the direction arrow 52 the end 54 of the door 10 comes into contact with the surface 46 of the hatch portion 40 in the end region 48 protruding through the entryway 30 thereby impacting damage to hatch portion 40.

Figure 5:
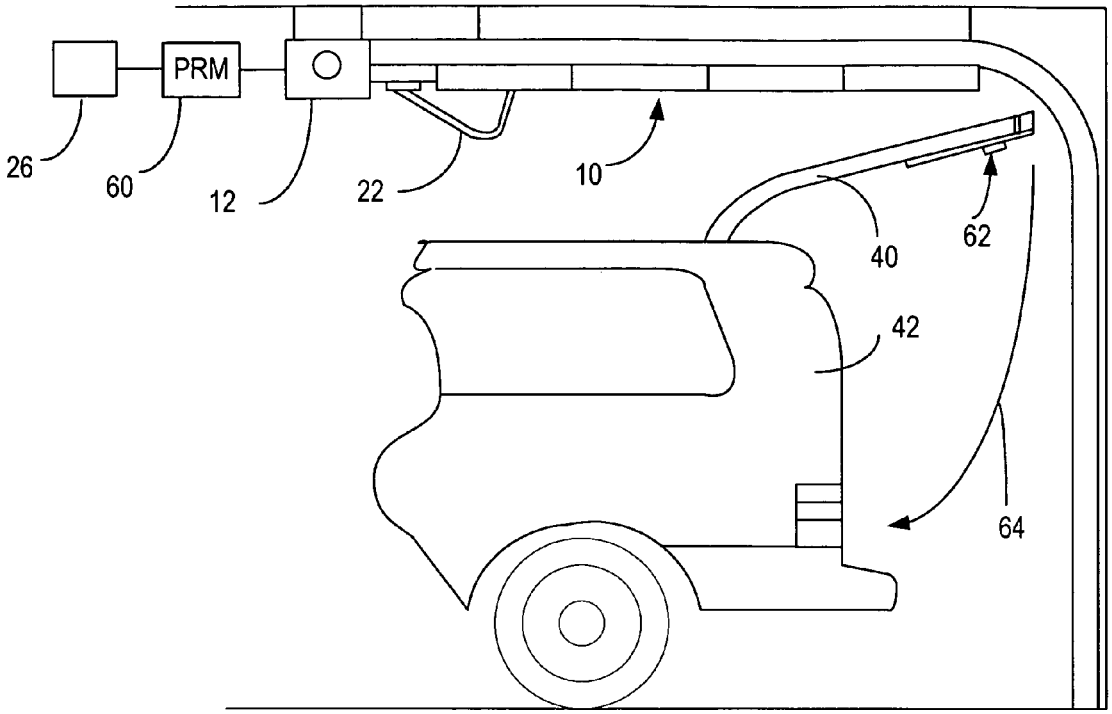
FIG. 5 is a schematic illustration showing an overhead door system embodying the overhead door immobilizer of the present invention preventing the overhead door from moving from its entry open position to its entry closed position in response to the hatch portion of the vehicle being in the hatch-open position.
Figure 6:
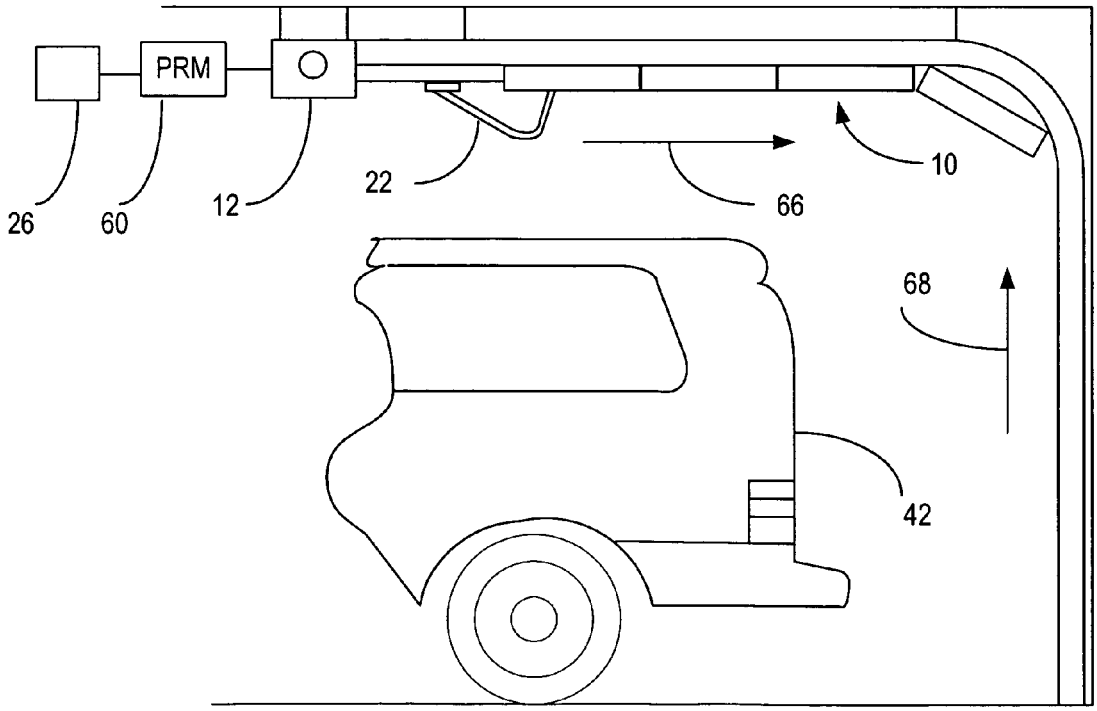
FIG. 6 is a schematic illustration showing an overhead door system embodying the overhead door immobilizer of the present invention enabling the overhead door to move from its entry open position to its entry closed position in response to the hatch portion of the vehicle being in the hatch-closed position.
Figure 7:
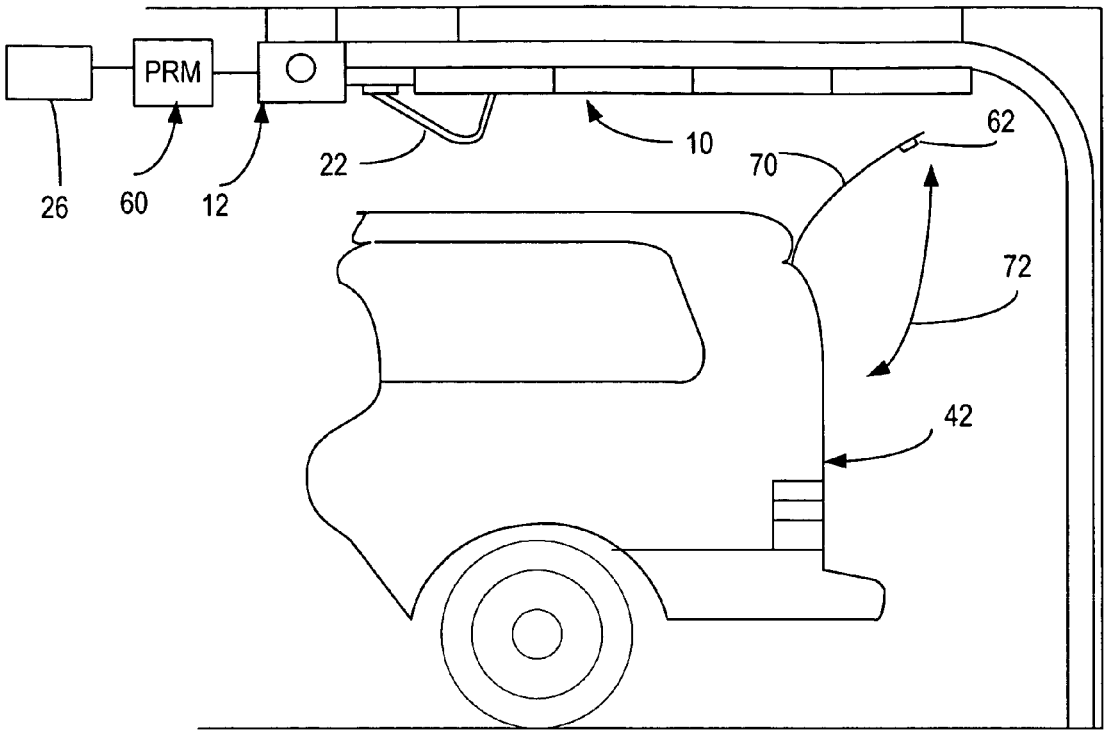
FIG. 7 is a schematic illustration showing an overhead door system embodying the overhead door immobilizer of the present invention preventing the overhead door from moving from its entry open position to its entry-closed position in response to the rear window of the hatch portion of the vehicle being in the window-open position.

Turning now to FIGS. 5, 6 and 7, the overhead door immobilizer embodying the present invention is schematically illustrated therein as it is used with a conventional overhead door system as illustrated in FIGS. 1-4. The overhead door immobilizer system embodying the present invention includes a power receiver module (PRM) generally designated 60 connected between overhead door power head operator 12 and the power source 26. The overhead door immobilizer embodying the present invention also includes a hatch position transmitter (HPT) generally designated 62 suitably attached to a convenient location on the hatch portion 40 of the vehicle 42. The PRM 60 and HPT 62 cooperate with one another to activate or deactivate the overhead door immobilizer system as follows. When the hatch portion 40 is in its open orientation such as illustrated in FIG. 5, the HPT 62 is in a first operative state and transmits a coded RF signal which is received by appropriate circuitry within the PRM 60 and which signal is decoded as indicating the hatch open position of the vehicle 42. The PRM 60 upon decoding the hatch open coded signal deactivates power to the overhead door power head operator 12 from the power source 26 so that any attempt to operate the power head operator 12 to close the door 10 is prevented and thus any potential damage to the hatch portion 40 caused by movement of the hanging arm 22 is avoided. When the hatch portion 40 is moved to its closed position as indicated by the direction arrow 64 and as illustrated in FIG. 6, the HPT 62 is in a second operative state corresponding to the hatch portion 40 being in a closed orientation and the HPT transmits a hatch closed RF coded signal which is received and decoded by the PRM 60 to activate power from the power source 26 to the power head operator 12 such that an enable command signal sent to the power head operator 12 causes the power head operator to drive the hanging arm 22 in the direction indicated by the direction arrow 66 to move the door 10 from its open position to its closed position. Likewise, if the door 10 is in its closed entry blocked position and an enable command signal is provided to the power head operator, the door 10 moves in the upper travel direction as indicated by the direction arrow 68 to move the door 10 to its open position. As illustrated in FIG. 7, the HPT 62 may likewise be mounted or attached to a convenient location on the rear hatch window generally designated 70 which pivots between an open position and a closed position as indicated by the direction arrow 72.

Figure 8:
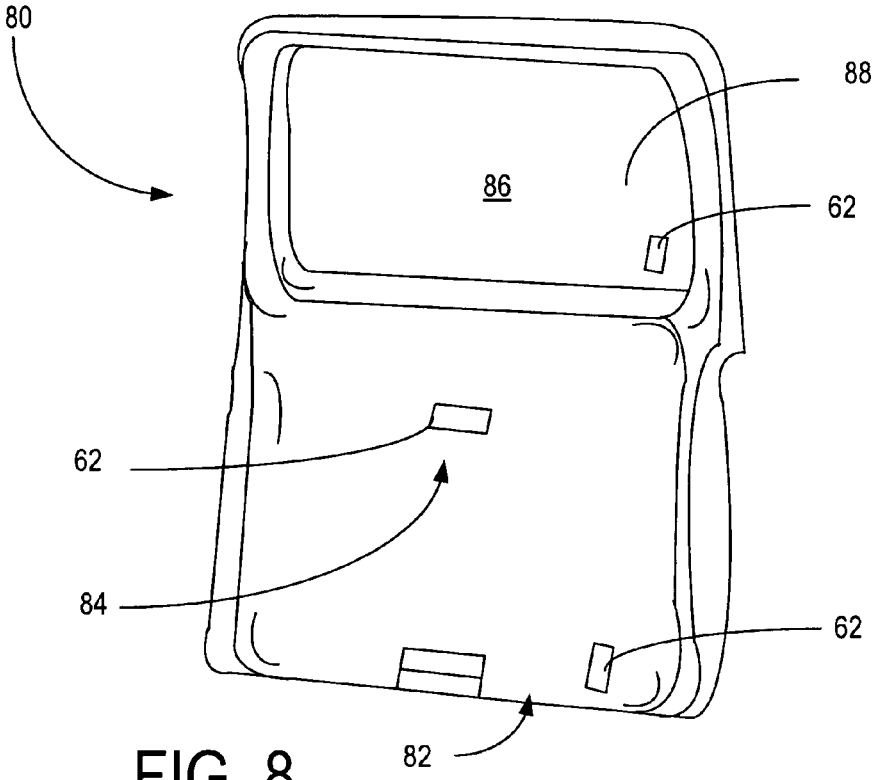
FIG. 8 is a schematic drawing of the interior facing side of a hatch-portion of a vehicle illustrating various possible mounting locations for the hatch position transmitter (HPT) of the overhead door immobilizer of the present invention.

FIG. 8 represents schematically the hatch portion of a vehicle for example a minivan which is arranged to open and close the rear cargo area of the van as well known and understood. In FIG. 8, the interior side of the hatch portion 80 is illustrated wherein the HPT 62 is shown attached to various locations on the interior surface side of the hatch portion 80 such as for example the lower region 82 of the hatch portion 80, the central region 84 intermediate the top and bottom and sides of the hatch portion 80 and on the surface. 86 of a window 88 of the hatch portion 80. The HPT may be attached for example using a VELCRO® strip, screws, or made integral with the hatch position or in any other way to carry out the intended function.

Figure 9:
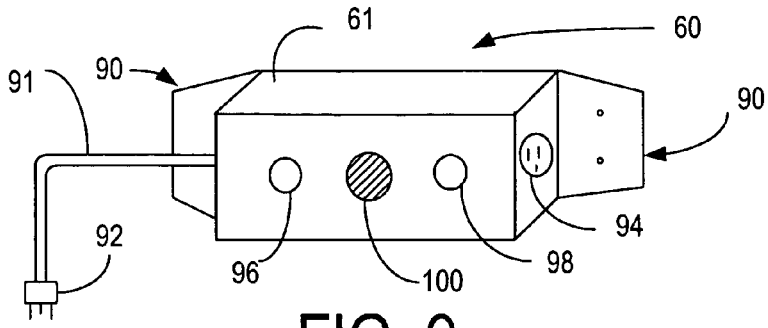
FIG. 9 is a schematic perspective view of the power receiver module (PRM) of the overhead door immobilizer of the present invention.

FIG. 9 illustrates schematically the power receiver module (PRM) 60 and contemplates that the PRM 60 case or enclosure 61 be conveniently mounted or suspended from the ceiling in a similar manner as the power head operator 12 by means of mounting tabs 90, 90 at either side of the housing 61. The PRM 60 includes a power cord 91 of suitable length terminating in a conventional AC plug 92 for connection to a standard commercial AC outlet. The PRM 60 also includes a conventional AC power outlet 94 to receive the AC plug of the power head operator. The PRM 60 also includes an alarm warning indicator which may be either an audible alarm or visual alarm. As shown in FIG. 9, a visual indicator lamp generally designated 96 flashes when the overhead door immobilizer system detects that the overhead door may be safely moved to or from its open or closed position respectively. Preferably, a green indicator lamp is used to indicate this condition however any color lamp may likewise be used. The PRM 60 also includes a visual alarm in the form of a flashing lamp 98 to indicate the overhead door is immobilized and not safe to move thus alerting the user that the hatch portion of the vehicle may not be in its proper closed position. Preferably, the indicator light flashes red, however, any suitable desired color lamp may be used. The PRM 60 may also include an audible alarm generally designated 100 such as piezoelectric sounding device which emits a predefined warning sound such as a beeping or other shrill alerting sound to advise the user that the hatch portion of the vehicle may not be in the proper closed position to allow safe movement of the overhead door.

Figure 10:
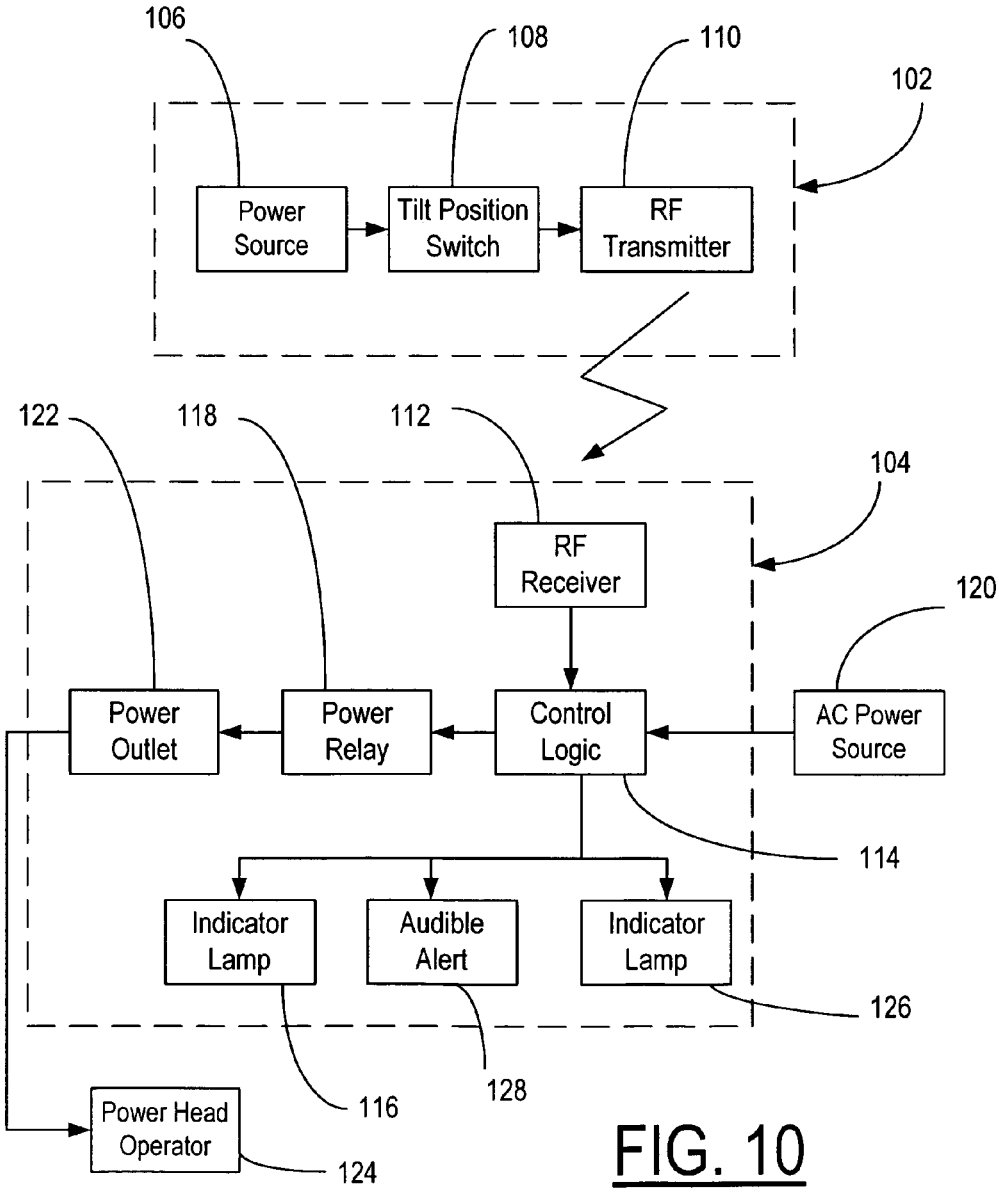
FIG. 10 is a block diagram of the major functional components of the overhead door immobilizer of the present invention.

Turning now to FIG. 10, a block diagram showing the major functional components of the overhead door immobilizer embodying the present invention is illustrated therein wherein the hatch position transmitter (HPT) is shown in the dashed line box 102 and the power receiver module (PRM) is shown in the dashed line box 104. The HPT module 102 includes a suitable power source generally designated 106, a tilt position switch 108 and appropriate electronic circuitry and RF transmitter 110 for sensing the orientation of the tilt position switch 108 and generating a corresponding coded RF signal for transmission to the PRM module 104. The power source 106 may be DC batteries which may be conventional or rechargeable. The tilt position switch 108 may be of any appropriate suitable design or type to carry out the intended function to determine the orientation of the hatch portion of the vehicle in either an open position or a closed position. The tilt position switch 108 may be a micro-tilt switch which opens or closes an electrical circuit in accordance with the orientation of the switch and may operate either mechanically or by means of a liquid conductive material such as mercury to open and close an electrical circuit. The RF transmitter 110 generates the appropriate RF hatch open coded signal or RF hatch closed coded signal in accordance with the orientation of the tilt position switch 108. An RF transmitter and tilt position switch suitable for use in the present invention is disclosed in U.S. Pat. No. 5,402,105 and which disclosure is incorporated by reference herein. The PRM module 104 includes an RF receiver 112 which receives and decodes the RF signal transmitted from the HPT module. If the RF coded signal is decoded as an indication that the hatch portion of the vehicle is closed, the decoded signal is fed to the control logic 114 which, after an appropriate time delay, energizes the indicator lamp 116 alerting the user that the door is safe to move. A power relay 118 is operated by the control logic 114 to connect the power from the AC power source 120 to the PRM module power outlet 122 to provide power to the overhead door power head operator 124 to move the door when an enable command signal is sent to the power head operator 124. If the hatch portion of the vehicle is in its open position, the RF transmitter 110 transmits an RF hatch closed coded signal which is received by the RF receiver 112. The RF receiver 112 decodes the RF hatch closed signal and provides the decoded signal to the control logic 114. The control logic 114 energizes the indicator lamp 126 to cause the lamp to flash alerting the user that the hatch portion of the vehicle is not in a proper closed position. The control logic 114 also energizes an audible device such as a piezoelectric electric element or buzzer 128 to alert the user that the hatch portion of the vehicle is not in the proper closed position to safely operate the overhead door. The control logic 114 also deactivates the power relay 118 to remove power from the power outlet 122 and accordingly power from the overhead power head operator 124 thereby immobilizing the overhead door.

Figure 11:
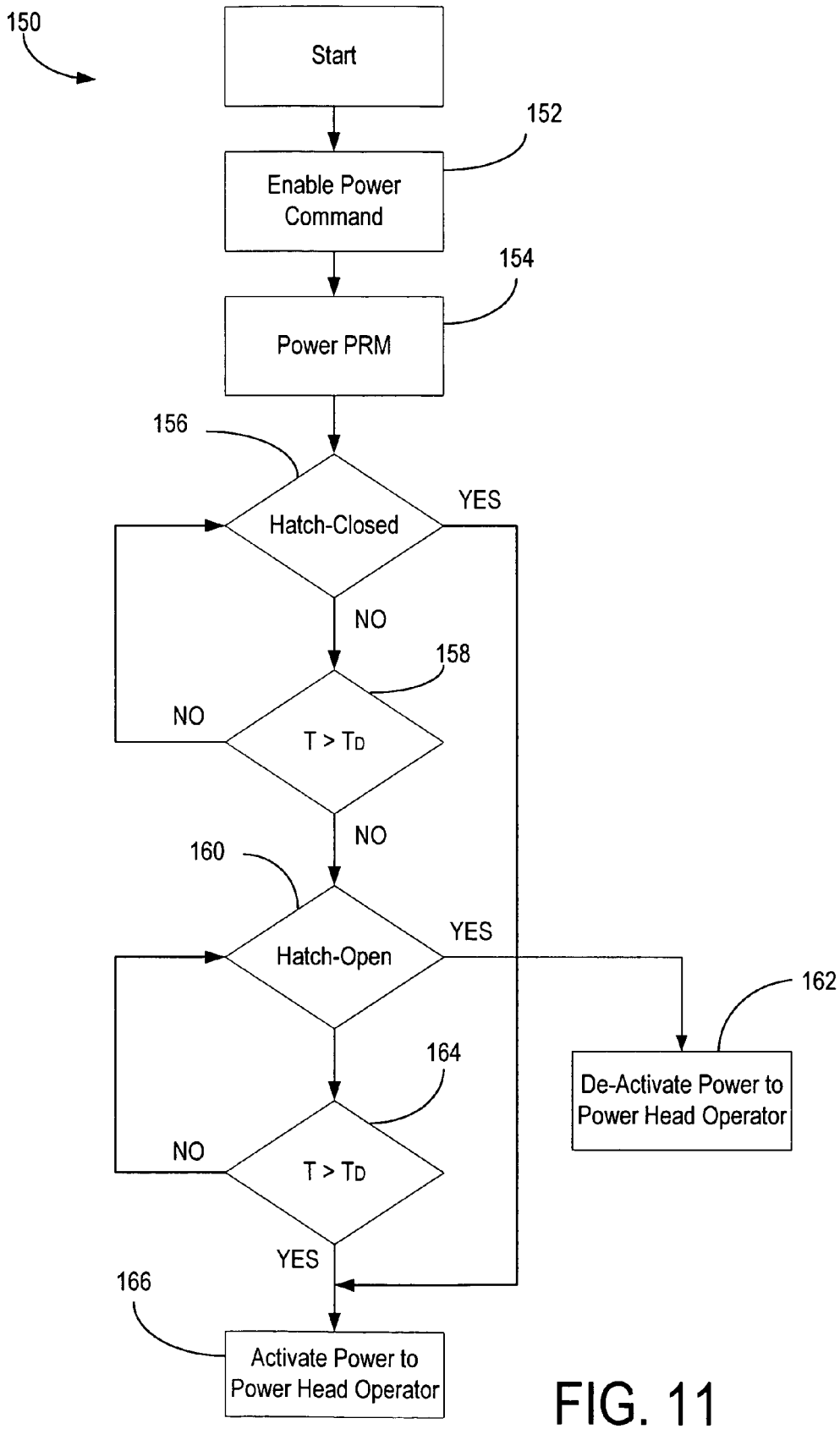
FIG. 11 is a flow chart showing the operational sequence of the overhead door immobilizer embodying the present invention.

Turning now to FIG. 11, a flow chart flowing the operational steps of the overhead door immobilizer embodying the present invention is illustrated therein and generally designated 150. The process starts with the receipt of an enable command signal 152 sent to the overhead door power head operator and power being sensed at the power receiver module in step 154. The control logic then tests in step 156 for the presence or absence of the hatch closed signal. If the hatch closed signal is not present, the system tests whether the time for receipt of the hatch closed signal exceeds a predetermined time as indicated in the step 158. If the signal is not received and the time has not exceeded the time delay, the process is repeated. If the time in step 158 exceeds the predetermined time delay, then the system moves to the step 160 to determine if the hatch open signal is present. If the hatch open signal is present, the system moves to deactivate power to the power head operator in step 162. If in step 160 the hatch open signal is not present, the system moves to step 164 to determine if the time has exceeded the predetermined time delay. If the time has not exceeded the predetermined time delay, the system re-tests to determine if the hatch open signal is present. If the time exceeds the predetermined time delay and the hatch open signal is not present and the hatch closed signal is not present, the system activates power to the power head operator in step 166. If the hatch closed signal is present in step 156, the system moves to step 166 to likewise activate power to the power head operator.

It will be recognized that the HPT will remain in its first operative state and second operative state respectively wherein the hatch portion may be within a position orientation range corresponding to the hatch partially open to fully open and hatch partially closed to fully closed. It will also be recognized that the HPT may transmit its RF coded signals at predetermined periodic time intervals and for a predetermined time as desired. The present invention contemplates operation utilizing any of a number of different protocols now known or adopted in the future due to government or other safety regulations.

The invention claimed:

1. Overhead door immobilizer comprising:

a power receiver module (PRM) electrically connected between an overhead door power head operator and an electrical power source for powering the overhead door power head operator;

a hatch position transmitter (HPT) suitably attached to the hatch portion of a vehicle, said HPT having a first operative state corresponding to the hatch portion being in a first orientation and a second operative state corresponding to the hatch portion being in a second orientation;

said power receiver module (PRM) being responsive to said hatch position transmitter in said first operative state whereby electrical power from the electrical power source energizes the overhead door power head operator to move the overhead door between its vertical orientation corresponding to a closed position and its horizontal orientation corresponding to an open position when an enable command signal is provided to the overhead door power head operator;

said power receiver module (PRM) further being responsive to said hatch position transmitter in said second operative state whereby electrical power from the electrical power source is prevented from energizing the overhead door power head operator to immobilize the overhead door from moving between its vertical orientation and its horizontal orientation when an enable command signal is provided to the overhead door power head operator.

2. The overhead door immobilizer as defined in claim 1 wherein said hatch portion first orientation corresponds to said hatch portion being in substantially a closed position on the vehicle.

3. The overhead door immobilizer as defined in claim 1 wherein said hatch portion second orientation corresponds to said hatch portion being in an open position on the vehicle.

4. The overhead door immobilizer as defined in claim 2 wherein said substantially closed position ranges from said hatch portion being in a fully closed position to a partially open position wherein said HPT remains in its said first operative state.

5. The overhead door immobilizer as defined in claim 3 wherein said open position ranges from said hatch portion being in a fully open position to a partially closed position wherein said HPT remains in its said second operative state.

6. The overhead door immobilizer as defined in claim 1 wherein said PRM includes an alarm warning indicator responsive to said HPT second operative state to alert a user of the vehicle that said hatch portion is in its second orientation.

7. The overhead door immobilizer as defined in claim 6 wherein said alarm warning indicator is an audible alarm.

8. The overhead door immobilizer as defined in claim 6 wherein said alarm warning indicator is a visual alarm.

9. The overhead door immobilizer as defined in claim 1 wherein said HPT transmits a first coded RF signal corresponding to its said first operative state and a second coded RF signal corresponding to its said second operative state.

10. The overhead door immobilizer as defined in claim 1 wherein said PRM is part of the overhead door power head operator.

11. The overhead door immobilizer as defined in claim 1 further characterized in that said PRM is responsive to the presence of said hatch position transmitter first operative state after a pre-defined time interval.

12. The overhead door immobilizer as defined in claim 1 further characterized in that said PRM is responsive to the absence of said hatch position transmitter second operative state after a pre-defined time interval.

13. Overhead door immobilizer comprising:

a power receiver module (PRM);

a hatch position transmitter (HPT);

said hatch position transmitter (HPT) arranged for attachment to a hatch portion of a vehicle and configured for transmitting a coded hatch-open signal when the hatch portion of a vehicle is in an open position and a coded hatch-closed signal when the hatch portion of a vehicle is in a closed position;

said power receiver module (PRM) activating electrical power to an overhead door power head operator in response to receiving said hatch-closed coded signal and de-activating electrical power to an overhead door power head operator in response to receiving said hatch-open coded signal when an enable command signal is provided to the overhead door power head operator.

14. The overhead door immobilizer as defined in claim 13 wherein said hatch-open coded signal is an RF hatch-open coded signal and said hatch-closed coded signal is an RF hatch-closed coded signal.

15. The overhead immobilizer as defined in claim 14 wherein said power receiver (PRM) includes control circuitry for receiving and decoding said RF hatch-open coded signal and said RF hatch-closed coded signal.

16. Overhead door immobilizer comprising:

a power receiver module (PRM) electrically connected between an overhead door power head operator and an electrical power source for powering the overhead door power head operator;

a hatch position transmitter (HPT) suitably attached to the hatch portion of a vehicle, said HPT having a first operative state corresponding to the hatch portion being in a first orientation and a second operative state corresponding to the hatch portion being in a second orientation;

said power receiver module (PRM) being responsive to said hatch position transmitter in said first operative state whereby electrical power from the electrical power source energizes the overhead door power head operator to move the overhead door between its vertical orientation corresponding to a closed position and its horizontal orientation corresponding to an open position when an enable command signal is provided to the overhead door power head operator;

said power receiver module (PRM) further being responsive to said hatch position transmitter in said second operative state whereby electrical power from the electrical power source is prevented from energizing the overhead door power head operator to immobilize the overhead door from moving between its vertical orientation and its horizontal orientation when an enable command signal is provided to the overhead door power head operator wherein said PRM includes an alarm warning indicator responsive to said HPT second operative state to alert a user of the vehicle that said hatch portion is in its second orientation.

17. The overhead door immobilizer as defined in claim 16 further characterized in that said PRM is responsive to the presence of said hatch position transmitter first operative state after a pre-defined time interval.

18. The overhead door immobilizer as defined in claim 16 further characterized in that said PRM is responsive to the absence of said hatch position transmitter second operative state after a pre-defined time interval.

* * * * *